US005791885A

United States Patent [19]

Fukuhara et al.

[11] Patent Number: 5,791,885

[45] Date of Patent: Aug. 11, 1998

[54] SCROLL COMPRESSOR HAVING POSITIONING MEANS FOR AXIALLY MOVABLE NON-ORBITING SCROLL

[75] Inventors: Hiroyuki Fukuhara; Sadayuki Yamada, both of Otsu; Noboru Iida, Kusatsu; Takeshi Hashimoto, Kyoto, all of Japan

[73] Assignee: Matsushita Electric Industrial Co., Ltd., Osaka, Japan

[21] Appl. No.: 682,378

[22] Filed: Jul. 17, 1996

[30] Foreign Application Priority Data

Jul. 18, 1995 [JP] Japan ..... 7-181293

[51] Int. Cl.[6] ..... F04C 18/04

[52] U.S. Cl. ..... 418/55.2; 418/55.5; 418/57

[58] Field of Search ..... 418/55.2, 55.5, 418/57

[56] References Cited

U.S. PATENT DOCUMENTS

| | | | |
|---|---|---|---|
| 4,767,293 | 8/1988 | Caillat et al. | 418/57 |
| 5,156,539 | 10/1992 | Anderson et al. | 418/55.5 |
| 5,192,202 | 3/1993 | Lee | 418/55.5 |
| 5,253,989 | 10/1993 | Shindo et al. | 418/55.2 |
| 5,346,376 | 9/1994 | Bookbinder et al. | 418/55.5 |

FOREIGN PATENT DOCUMENTS

| | | | |
|---|---|---|---|
| 4-314986 | 11/1992 | Japan . | |
| 4362201 | 12/1992 | Japan | 418/55.5 |
| 5149269 | 6/1993 | Japan | 418/55.5 |
| 6-81781 | 3/1994 | Japan | 418/55.5 |
| 6264877 | 9/1994 | Japan | 418/55.5 |

*Primary Examiner*—John J. Vrablik
*Attorney, Agent, or Firm*—Wenderoth, Lind & Ponack

[57] ABSTRACT

A scroll compressor has a closed vessel, a compression mechanism accommodated in the closed vessel and including a non-orbiting scroll and an orbiting scroll in engagement with each other, and an electric motor for driving the compression mechanism. The non-orbiting scroll includes a frame portion and a non-orbiting end plate axially movable relative to the frame portion. The frame portion has a recess defined therein and a pin secured thereto. The non-orbiting end plate has a cylindrical wall integrally formed therewith and loosely received in the recess, thereby radially positioning the non-orbiting end plate relative to the frame portion. The non-orbiting end plate also has a recess defined therein in which the pin is loosely received, thereby circumferentially positioning the non-orbiting end plate relative to the frame portion.

12 Claims, 7 Drawing Sheets

SCROLL COMPRESSOR HAVING POSITIONING MEANS FOR AXIALLY MOVABLE NON-ORBITING SCROLL

BACKGROUND OF THE INVENTION

1. Field of the Invention

The present invention relates to a scroll compressor suited for use in, for example, an air conditioner, a refrigerator or the like for business or domestic use.

2. Description of Related Art

Electrically-operated compressors are available in various types including a reciprocating type, a rotary type, a scroll type, and the like, and are widely used in air conditioners, refrigerators and the like for business or domestic use. The reciprocating or rotary compressors are characterized by high performance or low cost, while the scroll compressors are characterized by high performance, low noise or low vibration.

FIG. 11 depicts a conventional scroll compressor which generally comprises a closed vessel 1 and a compression mechanism 2 accommodated within an upper portion of the closed vessel 1. The compression mechanism 2 includes a non-orbiting scroll 29 having a frame portion 29*a* and a non-orbiting end plate 29*b*, and an orbiting scroll 2*b* having an orbiting end plate. The non-orbiting scroll 29 also has a non-orbiting scroll wrap integrally formed with the non-orbiting end plate 29*b*, while the orbiting scroll 2*b* also has an orbiting scroll wrap integrally formed with the orbiting end plate, with the non-orbiting and orbiting scroll wraps being in engagement with each other. The orbiting scroll 2*b* has a shaft 2*c* integrally formed therewith and journaled in an eccentric bearing 6, which is in turn accommodated within a recess defined in an upper end portion of a crank shaft 5. An upper portion of the crank shaft 5 is supported by a bearing member 4 with which a thrust bearing 3 is integrally formed to axially support the orbiting scroll 2*b*. The bearing member 4 is sealingly secured at its peripheral portion to the closed vessel 1. An electric motor 7 is disposed below the bearing member 4 and is made up of a rotor 7*a* securely mounted on the crank shaft 5 and a stator 7*b* rigidly secured to the closed vessel 1 by shrink fitting. The crank shaft 5 is radially supported by a main bearing 8 interposed between it and the bearing member 4 and by an auxiliary bearing 23 disposed below the electric motor 7, and is driven by the electric motor 7 to cause the orbiting scroll 2*b* to undergo an orbiting motion relative to the non-orbiting scroll 29.

The closed vessel 1 is provided at its bottom portion with an oil storage portion 10 for storing lubricating oil 9 and at its side portion with a suction pipe 11 rigidly secured thereto for introducing gas thereinto. The pressure of suction gas acts within the closed vessel 1. The bearing member 4 has an oil discharge conduit 12 defined therein for discharging the lubricating oil 9 which has lubricated and cooled the main bearing 8, the auxiliary bearing 23, the eccentric bearing 6, and the thrust bearing 3. The crank shaft 5 has a through-hole 13 defined therein along a longitudinal axis thereof for supplying the main bearing 8, the auxiliary bearing 23, the eccentric bearing 6, and the thrust bearing 3 with the lubricating oil 9 to lubricate and cool them. The crank shaft 5 also has an oil guide 14 mounted on a lower end thereof by press fitting or shrink fitting for sucking up the lubricating oil 9 through the through-hole 13. The closed vessel 1 has a discharge chamber 15 defined therein above the non-orbiting scroll 29.

The scroll compressor shown in FIG. 11 also includes a discharge pipe 16 rigidly secured to the closed vessel 1 for discharging compressed high-pressure gas to the outside of the closed vessel 1, a check valve 19 mounted on the frame portion 29*a* for preventing contrarotation of the orbiting scroll 2*b* when the scroll compressor is stopped, a valve guide 24 disposed above the check valve bolted to the frame portion 29*a* for restricting a vertical movement of the check valve 19, and an Oldham ring 20 for preventing the orbiting scroll 2*b* from rotating about its own axis while permitting it to undergo an orbiting motion relative to the non-orbiting scroll 29.

The frame portion 29*a* of the non-orbiting scroll 29 is bolted to the bearing member 4, but is spaced a predetermined distance therefrom by means of a plurality of, for example, four, guide posts 30. The guide posts 30 are loosely inserted in associated guide holes 29*c* defined in the non-orbiting end plate 29*b* so as to allow an axial movement of the non-orbiting scroll 29.

The scroll compressor of the above-described construction operates as follows.

A low-pressure gas is first introduced into the closed vessel 1 through the suction pipe 11 and then into the compression mechanism 2. An orbiting motion of the orbiting scroll 2*b* relative to the non-orbiting scroll 29 compresses the low-pressure suction gas into a high-pressure gas, which is in turn introduced into the discharge chamber 15. The high-pressure gas thus obtained is discharged to the outside of the closed vessel 1 through the discharge pipe 16 to operate a working part. Upon operation of the working part, the high-pressure gas is turned into a low-pressure gas, which is returned back to the suction pipe 11, thus forming a known compression cycle.

On the other hand, lubricating oil 9 sucked up by the oil guide 14 moves upwardly along the through-hole 13 defined in the crank shaft 5, and lubricates and cools the auxiliary bearing 23, the eccentric bearing 6, the thrust bearing 3, and the main bearing 8. Thereafter, the lubricating oil 9 is discharged above the stator 7*b* through the oil discharge conduit 12 and is eventually returned back to the oil storage portion 10 through a groove 18 defined in the stator 7*b*, thus forming a known lubrication cycle.

It is known that the compression efficiency is enhanced by reducing leakage of compressed gas at the free ends of the non-orbiting and orbiting scroll wraps.

Anderson et al. (USP 5,156,539) discloses a scroll machine having an axially movable non-orbiting scroll. The non-orbiting scroll has a plurality of circumferentially spaced mounting bosses each having an axial bore in which a sleeve bolted to a main bearing housing is slidably disposed.

Japanese Laid-Open Patent Publication (unexamined) No. 4-314986 discloses a closed scroll compressor having an axial compliance mechanism for axially and radially biasing an orbiting scroll against a non-orbiting scroll. The non-orbiting scroll has a frame and an end plate axially movably mounted on the frame by a couple of pins, while the orbiting scroll has a drive plate and an end plate axially movably mounted on the drive plate by a couple of pins.

In each of the above-described constructions, if the non-orbiting scroll is not allowed to axially smoothly move relative to the orbiting scroll without creating any axial gap between the non-orbiting and orbiting scroll wraps, there occurs considerable leakage of compressed gas, thereby damaging the compressor.

Furthermore, in order to obtain a desired performance, it is necessary to assemble the non-orbiting and orbiting scrolls with a predetermined phase difference held therebetween. During a compression stroke, if this phase difference and an orbiting radius are not maintained unchanged and if the compression mechanism cannot be readily assembled, an efficient and inexpensive scroll compressor allowing a smooth axial movement of the non-orbiting scroll cannot be expected.

Although in the scroll compressor shown in FIG. 11 the non-orbiting scroll 29 is allowed to axially move along the guide posts 30, if the circumferential pitch of the guide posts 30 does not coincide with that of the guide holes 29*c* of the non-orbiting end plate 29*b*, the non-orbiting scroll 29 cannot smoothly move in the axial direction. The same is true for the case where even one of the plurality of guide posts 30 is not secured perpendicular to the bearing member 4. In such cases, it takes a lot of time and expense to assemble the compression mechanism and to machine the surface of the bearing member 4 and the end surfaces of the guide posts 30.

Moreover, if the external diameters of the guide posts 30 do not match the internal diameters of the guide holes 29*c*, it is difficult to accurately position the non-orbiting end plate 29*b* in both the radial and circumferential directions, thus preventing a smooth axial movement of the non-orbiting scroll 29.

In consideration of machining and assembling errors, it is possible to make the internal diameters of the guide holes 29*c* considerably greater than the external diameters of the guide posts 30. In this case, however, the movement of the non-orbiting scroll wrap relative to the orbiting scroll wrap during compression greatly varies in both the radial and circumferential directions, thus lowering the compressor efficiency. In addition, when the guide posts 30 are mounted on the bearing member 4, it is necessary to pay close attention to engage the non-orbiting and orbiting scroll wraps with each other with a predetermined phase difference held therebetween, resulting in an increase in manufacturing cost.

SUMMARY OF THE INVENTION

The present invention has been developed to overcome the above-described disadvantages.

It is accordingly an objective of the present invention to provide a highly efficient scroll compressor capable of restraining an undesirable phase variation of the non-orbiting and orbiting scroll wraps during compression and of making an axial movement of the non-orbiting end plate smooth.

Another objective of the present invention is to provide the scroll compressor of the above-described type which is simple in construction and can be readily manufactured at a low cost.

In accomplishing the above and other objectives, the scroll compressor according to the present invention has a closed vessel, a compression mechanism accommodated in the closed vessel and including a non-orbiting scroll and an orbiting scroll in engagement with each other, and a drive means for driving the compression mechanism. The non-orbiting scroll comprises a frame portion and a non-orbiting end plate axially movable relative to the frame portion. The frame portion has a recess defined therein and a pin secured thereto, while the non-orbiting end plate has a cylindrical wall integrally formed therewith and loosely received in the recess, thereby radially positioning the non-orbiting end plate relative to the frame portion. The non-orbiting end plate also has a recess defined therein in which the pin is loosely received, thereby circumferentially positioning the non-orbiting end plate relative to the frame portion.

By this construction, radial and circumferential positioning of the axially movable non-orbiting end plate relative to the frame portion can be readily carried out. Also, the cylindrical wall of the non-orbiting end plate can be readily finished by cutting. The pin can be secured, for example, by press fitting or shrink fitting, while the recess can be readily accurately formed using a drill, a reamer, an end mill or the like if it is a round recess. Accordingly, the non-orbiting end plate and the frame portion constituting the non-orbiting scroll are assembled together with accuracy in both the radial and circumferential directions and, hence, the positional relationship between the non-orbiting and orbiting scroll wraps during compression is maintained as designed, resulting in a highly efficient and inexpensive scroll compressor.

Advantageously, the cylindrical wall is positioned radially inwardly of the pin. Because the size or diameter to which the cylindrical wall is finished by cutting becomes small, the precision thereof is improved, making it possible to reduce the clearance between the cylindrical wall and the recess and to axially smoothly move the non-orbiting end plate along the guide wall surface of the recess. As a result, gas leakage at the free ends of the non-orbiting and orbiting scroll wraps can be minimized.

Conveniently, the non-orbiting end plate is radially positioned relative to the frame portion by engagement of an internal surface of the cylindrical wall with an internal wall surface of the recess of the frame portion.

Alternatively, the non-orbiting end plate may be radially positioned relative to the frame portion by engagement of an external surface of the cylindrical wall with an external wall surface of the recess of the frame portion.

Advantageously, the recess of the non-orbiting end plate is elongated and has opposing straight side walls extending parallel to each other. The elongated recess can be readily accurately formed using, for example, an end mill. Because the radial positioning of the non-orbiting end plate is achieved by the cylindrical wall and the recess of the frame portion, it is sufficient if the circumferential position of the opposing straight side walls of the recess of the non-orbiting end plate is accurate, and the radial position of the pin is insignificant. Accordingly, un undesirable tilt of the non-orbiting scroll, which may be caused, if the recess is round, by an error in center distance between the cylindrical wall and the recess, is eliminated and, hence, the positioning accuracy of the non-orbiting end plate is enhanced, thus facilitating machining and enabling highly accurate assembling.

Although not only the circumferential position of the opposing straight side walls but also the width of the elongated recess must be accurately determined, accurate machining can be readily carried out. The reason for this is that similar accurate machining is required to groove an Oldham ring which is frequently employed in a scroll compressor to prevent the orbiting scroll from rotating about its own axis. The accurate machining makes it possible to accurately combine the non-orbiting and orbiting scroll wraps as if they are of an integral structure.

The cylindrical wall may be positioned radially outwardly of the pin. By this arrangement, the size or diameter to which the cylindrical wall and the corresponding recess is finished by cutting becomes large, tools having a relatively high rigidity can be used to enhance the dimensional accuracy, thus making it possible to reduce the clearance between the cylindrical wall and the corresponding recess and to axially smoothly move the non-orbiting end plate along the guide wall surface of the recess. Accordingly, gas leakage at the free ends of the non-orbiting and orbiting scroll wraps can be minimized, resulting in an efficient scroll compressor.

The cylindrical wall may be formed so as to extend from an outer edge of the non-orbiting end plate in a direction perpendicular thereto.

Advantageously, the maximum movable length of the non-orbiting end plate is determined by a formula of $\tan^{-1}L1/d > \tan^{-1}L2/D$, wherein L1: the maximum clearance between an internal wall surface of the recess and an internal surface of the cylindrical wall, d: the axial length of that portion of the cylindrical wall which is inserted into the recess, L2: the maximum movable length of the non-orbiting end plate in an axial direction when the compression mechanism has been assembled, and D: the outer diameter of the non-orbiting end plate.

This dimensional relationship causes the non-orbiting end plate to axially smoothly move relative to the frame portion under any circumstances. The reason for this is that even if the non-orbiting end plate excessively tilts, an outer edge of the non-orbiting end plate contacts with the frame portion before the cylindrical wall is brought into contact with the internal wall surface of the recess at two diametrically opposite locations to lock the non-orbiting end plate immovable.

The pin may be secured to the non-orbiting end plate, while the recess for receiving the pin therein may be formed in the frame portion.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
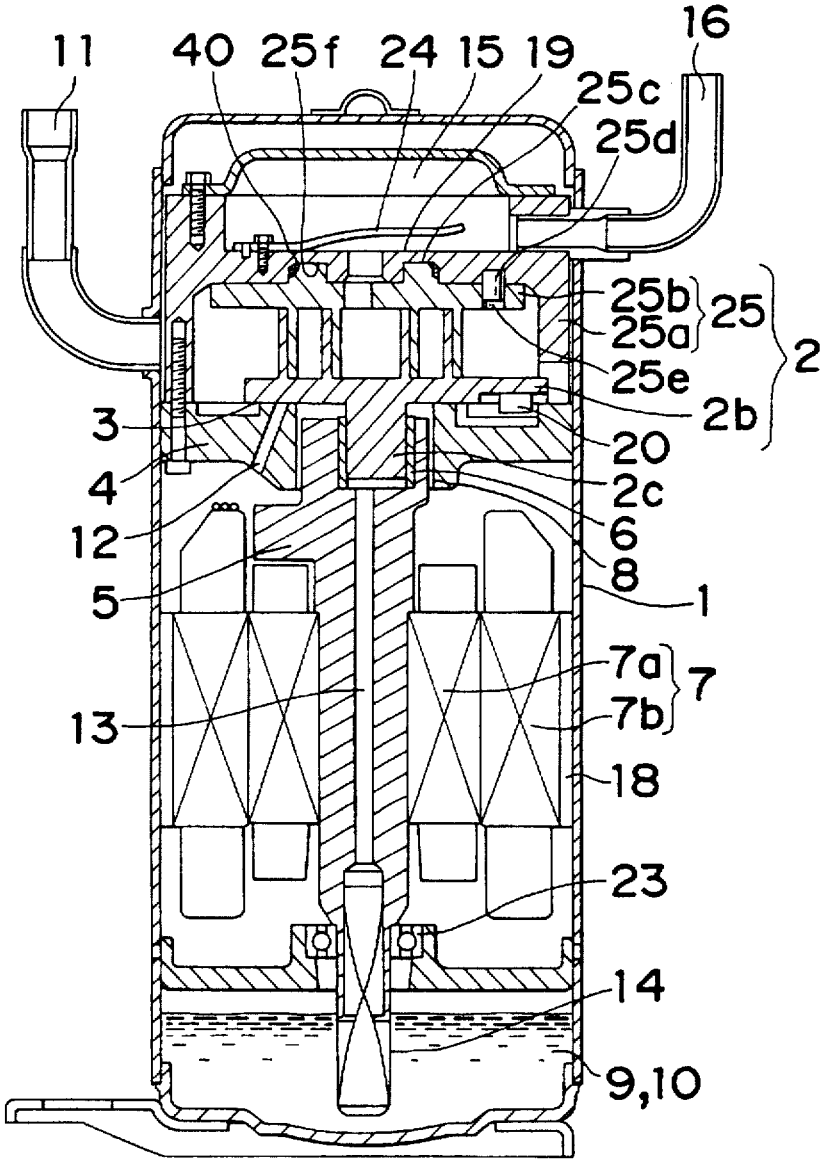
FIG. 1 is a vertical sectional view of a scroll compressor according to the present invention.

Referring now to the drawings, there is shown in FIG. 1 a scroll compressor embodying the present invention. The scroll compressor shown therein comprises a closed vessel 1 and a compression mechanism 2 accommodated within an upper portion of the closed vessel 1. The compression mechanism 2 includes a non-orbiting scroll 25 having a frame portion 25*a* and a non-orbiting end plate 25*b*, and an orbiting scroll 2*b* having an orbiting end plate. The non-orbiting scroll 25 also has a non-orbiting scroll wrap integrally formed with the non-orbiting end plate 25*b*, while the orbiting scroll 2*b* also has an orbiting scroll wrap integrally formed with the orbiting end plate, with the non-orbiting and orbiting scroll wraps being in engagement with each other. The non-orbiting scroll 25 further has a cylindrical wall 25*c* integrally formed with the non-orbiting end plate 25*b* so as to extend upwardly therefrom. The frame portion 25*a* of the non-orbiting scroll 25 has a downwardly open cylindrical recess 25*f* defined therein to axially slidably receive the cylindrical wall 25*c*. The center of the cylindrical wall 25*c* is aligned with that of the non-orbiting end plate 25*b*, while the center of the cylindrical recess 25*f* is aligned with that of the frame portion 25*a*. The frame portion 25*a* has a pin 25*d* pressed or shrink-fitted thereinto and loosely received in a round recess 25*e* defined in the non-orbiting end plate 25*b*, thereby circumferentially positioning the non-orbiting end plate 25*b* relative to the frame portion 25*a*.

The orbiting scroll 2*b* has a shaft 2*c* integrally formed therewith and journaled in an eccentric bearing 6, which is in turn accommodated within a recess defined in an upper end portion of a crank shaft 5. An upper portion of the crank shaft 5 is supported by a bearing member 4 with which a thrust bearing 3 is integrally formed to axially support the orbiting scroll 2*b*. The frame portion 25*a* of the non-orbiting scroll 25 is bolted to the bearing member 4. An electric motor 7 is disposed below the bearing member 4 and is made up of a rotor 7*a* securely mounted on the crank shaft 5 and a stator 7*b* rigidly secured to the closed vessel 1 by shrink fitting. The crank shaft 5 is radially supported by a main bearing 8 interposed between it and the bearing member 4 and by an auxiliary bearing 23 disposed below the electric motor 7. The crank shaft 5 is driven by the electric motor 7 to cause the orbiting scroll 2*b* to undergo an orbiting motion relative to the non-orbiting scroll 25.

The closed vessel 1 is provided at its bottom portion with an oil storage portion 10 for storing lubricating oil 9 and at its side portion with a suction pipe 11 rigidly secured thereto for introducing gas thereinto. The pressure of suction gas acts within the closed vessel 1. The bearing member 4 has an oil discharge conduit 12 defined therein for discharging the lubricating oil 9 which has lubricated and cooled the main bearing 8, the auxiliary bearing 23, the eccentric bearing 6, and the thrust bearing 3. The crank shaft 5 has a through-hole 13 defined therein along a longitudinal axis thereof for supplying the main bearing 8, the auxiliary bearing 23, the eccentric bearing 6, and the thrust bearing 3 with the lubricating oil 9 to lubricate and cool them. The crank shaft 5 also has an oil guide 14 mounted on a lower end thereof by press fitting or shrink fitting for sucking up the lubricating oil 9 through the through-hole 13. The closed vessel 1 has a discharge chamber 15 defined therein above the non-orbiting scroll 25.

The scroll compressor also includes a discharge pipe 16 rigidly secured to the closed vessel 1 for discharging compressed high-pressure gas to the outside of the closed vessel 1, a check valve 19 mounted on the frame portion 25*a* for preventing contrarotation of the orbiting scroll 2*b* when the scroll compressor is stopped, a valve guide 24 disposed above the check valve 19 and bolted to the frame portion 25*a* for restricting a vertical movement of the check valve 19, and an Oldham ring 20 for preventing the orbiting scroll 2*b* from rotating about its own axis while permitting it to undergo an orbiting motion relative to the non-orbiting scroll 25.

The scroll compressor of the above-described construction operates as follows.

A low-pressure gas is first introduced into the closed vessel 1 through the suction pipe 11 and then into the compression mechanism 2. An orbiting motion of the orbiting scroll 2*b* relative to the non-orbiting scroll 25 compresses the low-pressure suction gas into a high-pressure gas, which is in turn introduced into the discharge chamber 15. The high-pressure gas thus obtained is discharged to the outside of the closed vessel 1 through the discharge pipe 16 to operate a working part. Upon operation of the working part, the high-pressure gas is turned into a low-pressure gas, which is returned back to the suction pipe 11, thus forming a known compression cycle.

The high-pressure gas discharged from the discharge hole D of the end plate 25*b* is applied to the upper surface of the non-orbiting end plate 25*b* via the space S (see FIG. 2) inside the cylindrical wall 25*c*, and this high pressure gas biases the non-orbiting scroll 25 towards the orbiting scroll 2*b* against the gas pressure inside working chambers defined between the non-orbiting and orbiting scroll wraps to reduce an axial gap between the non-orbiting and orbiting scroll wraps. To this end, a sealing element 40 is interposed between an external wall surface of the cylindrical recess 25*f* and that of the cylindrical wall 25*c*. A compression spring may be interposed between the frame portion 25*a* and the non-orbiting end plate 25*b* to bias the non-orbiting scroll 25 towards the orbiting scroll 2*b*.

In the above-described construction, because the pin 25*d* for circumferentially positioning the non-orbiting scroll 25 may have a relatively small diameter and because the cylindrical wall 25*c* may also have a relatively small diameter, the radial position of the pin 25*d* on the frame portion 25*a* and that of the cylindrical wall 25*c* on the non-orbiting end plate 25*b* can be accurately and effectively determined by cutting operations during manufacture of respective component parts. The relatively small diameter of the cylindrical wall 25*c* ensures the dimensional accuracy, and the positional variation of the non-orbiting end plate 25*b* relative to the frame portion 25*a* during compression can be reduced to the extent of being negligible by reducing a clearance between an internal wall surface of the cylindrical recess 25*f* and that of the cylindrical wall 25*c*, thus allowing the non-orbiting scroll 25 to smoothly move in the axial direction. Because it is easy to accurately position the pin 25*d* on the frame portion 25*a* and the round recess 25*e* in the non-orbiting end plate 25*b* during machining, the circumferential position of the non-orbiting scroll wrap can be readily determined based on the position of the recess 25*e*. Accordingly, the frame portion 25*a* and the non-orbiting end plate 25*b* can be assembled together with sufficient accuracy corresponding to the structure wherein these members 25*a* and 25*b* are integrally formed with each other. Because of this, an undesirable positional deviation between the non-orbiting and orbiting scroll wraps during compression is reduced, and the non-orbiting end plate 25*b* is allowed to smoothly move in the axial direction to prevent gas leakage at the free ends of the non-orbiting and orbiting scroll wraps, resulting in a highly efficient scroll compressor.

It is to be noted that although in FIG. 1 the pin 25*d* is illustrated as being positioned externally of the cylindrical wall 25*c*, the former may be positioned internally of the latter.

It is also to be noted that although in FIG. 1 the pin 25*d* is illustrated as being secured to the frame portion 25*a*, the pin 25*d* may be secured to the non-orbiting end plate 25*b*. In this case, the frame portion 25*a* is required to have a round recess for receiving the pin therein.

Figure 2:
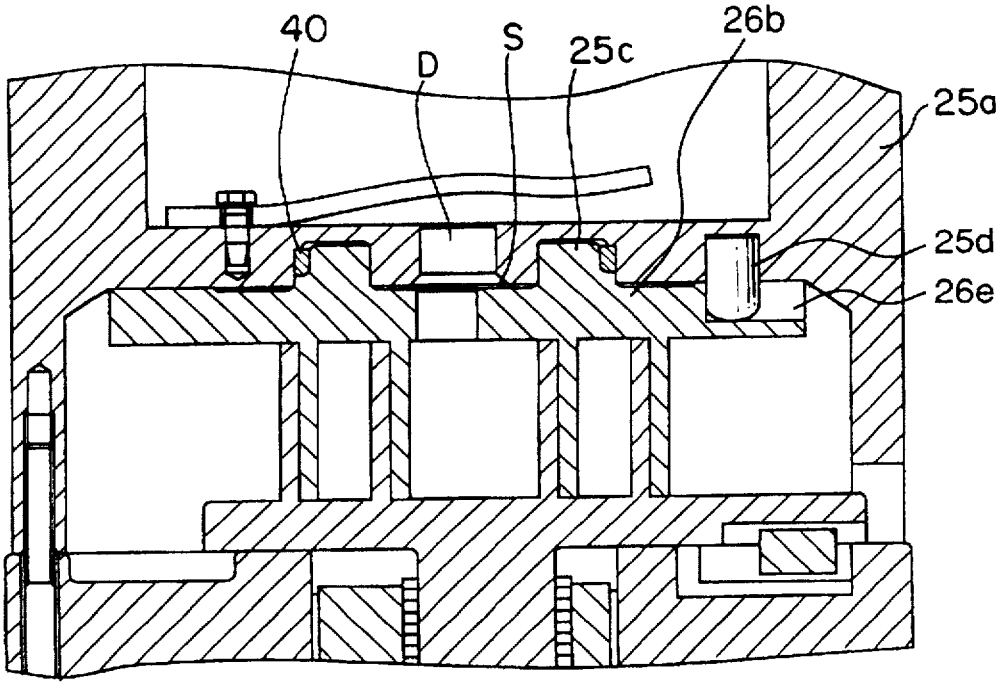
FIG. 2 is a vertical sectional view of a compression mechanism mounted in the scroll compressor of FIG. 1.
Figure 3:
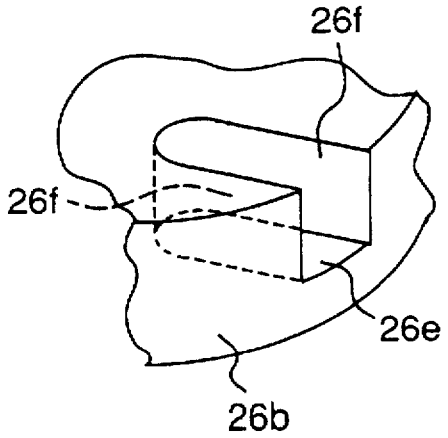
FIG. 3 is a fragmentary perspective view of an elongated recess defined in a non-orbiting end plate shown in FIG. 2.

FIGS. 2 and 3 depict a modified form of the non-orbiting end plate 25*b*. A non-orbiting end plate 26*b* shown therein has a radially elongated recess 26*e* defined therein and having opposing straight side walls 26*f* extending parallel to each other. The pin 25*d* secured to the frame portion 25*a* is loosely inserted into the elongated recess 26*e* to circumferentially position the non-orbiting end plate 26*b*.

Because the recess 26*e* for receiving the pin 25*d* therein is radially elongated, it is sufficient if the pin 25 is accurately positioned on the frame portion 25*a* in only the circumferential direction thereof. Although the circumferential position of the opposing straight side walls 26*f* and the width of the elongated recess 26*e* must be accurately determined, accurate machining can be readily performed. The reason for this is that similar accurate machining is generally performed in grooving the Oldham ring 20. The circumferential position of the non-orbiting scroll wrap can be readily determined based on the circumferential position of the elongated recess 26*e*.

Figure 4:
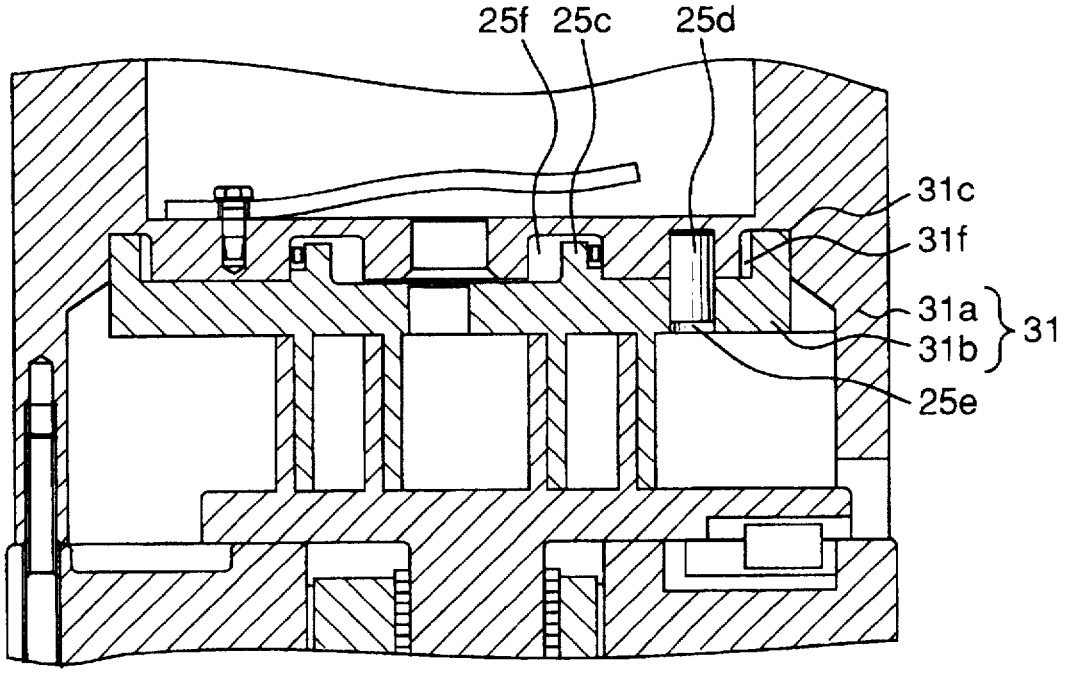
FIG. 4 is a view similar to FIG. 2, but indicating a modification thereof.

FIG. 4 depicts a modified form of the non-orbiting scroll 25. A non-orbiting scroll 31 shown therein comprises a frame portion 31*a* having a downwardly open second cylindrical recess 31*f* defined therein and a non-orbiting end plate 31*b* having a second cylindrical wall 31*c* integrally formed therewith so as to extend upwardly from an outer edge thereof. The center of the second cylindrical wall 31*c* is aligned with that of the non-orbiting end plate 31*b*, while the center of the second cylindrical recess 31*f* is aligned with that of the frame portion 31*a*. In this modification, the pin 25*d* is positioned externally of the cylindrical recess 25*f* (hereinafter referred to as the first cylindrical recess) and internally of the second cylindrical recess 31*f*, while the round recess 25*e* for receiving the pin 25 therein is likewise positioned externally of the cylindrical wall 25*c* (hereinafter referred to as the first cylindrical wall) and internally of the second cylindrical wall 31*c*. The clearance between the internal wall surface of the first cylindrical recess 25*f* and that of the first cylindrical wall 25*c* is sufficiently large so as not to allow them to contact with each other.

Because the second cylindrical wall 31*c* and the second cylindrical recess 31*f* are considerably greater in diameter than the first cylindrical wall 25*c* and the first cylindrical recess 25*f*, the accuracy in radial position of the second cylindrical wall 31*c* and the second cylindrical recess 31*f* can be enhanced. Also, the second cylindrical wall 31*c* and the second cylindrical recess 31*f* can be machined using associated tools having a relatively high rigidity, thus ensuring the dimensional accuracy. In addition, because the second cylindrical wall 31*c* and the second cylindrical recess 31*f* are placed within a low-temperature and low-pressure atmosphere, they are little affected by temperature and pressure and are, hence, subject to lesser dimensional changes or deformations. Accordingly, the positional variation of the non-orbiting end plate 31b relative to the frame portion 31a during compression can be reduced to the extent of being negligible by reducing a clearance between an external wall surface of the second cylindrical recess 31f and that of the second cylindrical wall 31c, thus allowing the non-orbiting scroll 31 to smoothly move in the axial direction.

Figure 5:
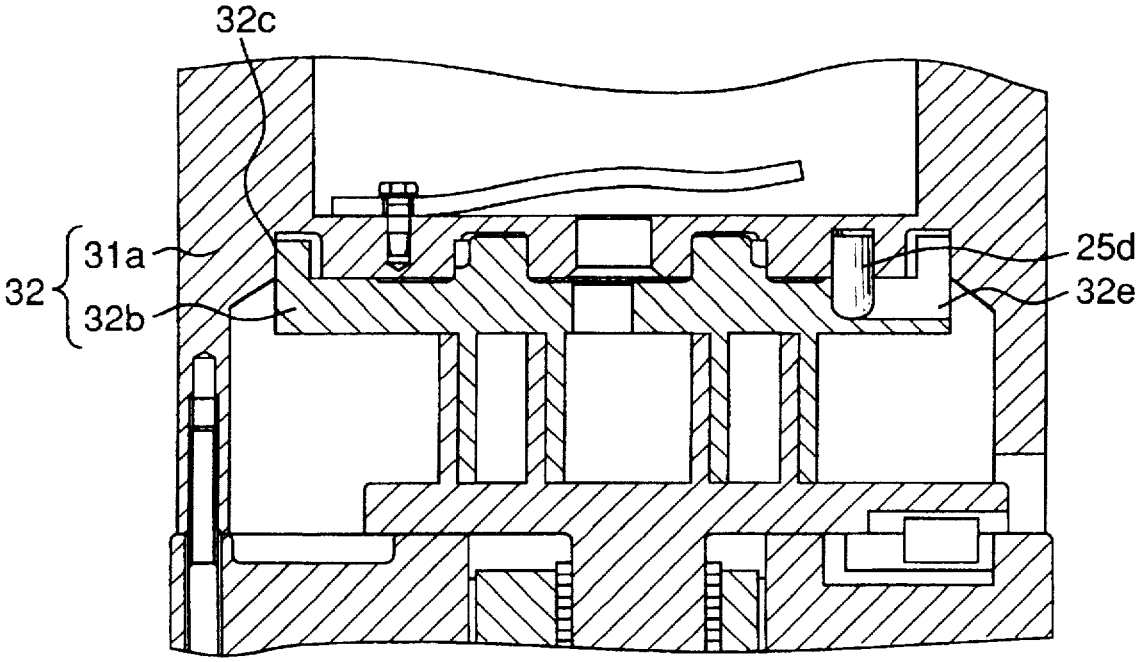
FIG. 5 is a view similar to FIG. 2, but indicating another modification thereof.
Figure 6:
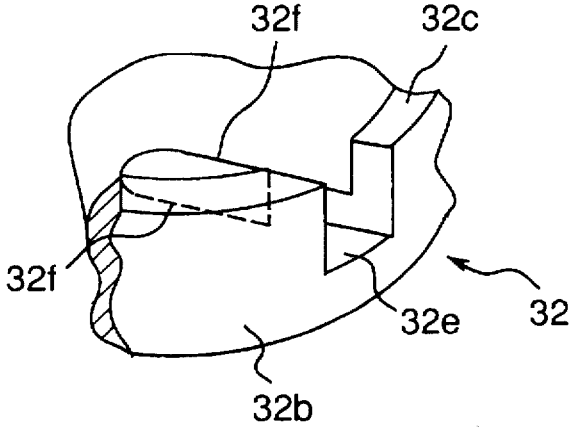
FIG. 6 is a fragmentary perspective view of an elongated recess defined in a non-orbiting end plate shown in FIG. 5.

FIGS. 5 and 6 depict another modified form of the non-orbiting scroll. A non-orbiting scroll 32 shown therein includes a non-orbiting end plate 32b having a second cylindrical wall 32c integrally formed therewith so as to extend upwardly from an outer edge thereof. As is the case with the non-orbiting scroll 31 shown in FIG. 4, the second cylindrical wall 32c is received in the second cylindrical recess 31f defined in the frame portion 31a. The non-orbiting end plate 32b, however, has a radially elongated recess 32e defined therein and having opposing straight side walls 32f extending parallel to each other, like the radially elongated recess 26e shown in FIGS. 2 and 3. The pin 25d secured to the frame portion 31a is loosely inserted into the elongated recess 32e to circumferentially position the non-orbiting end plate 32b.

Figure 7:
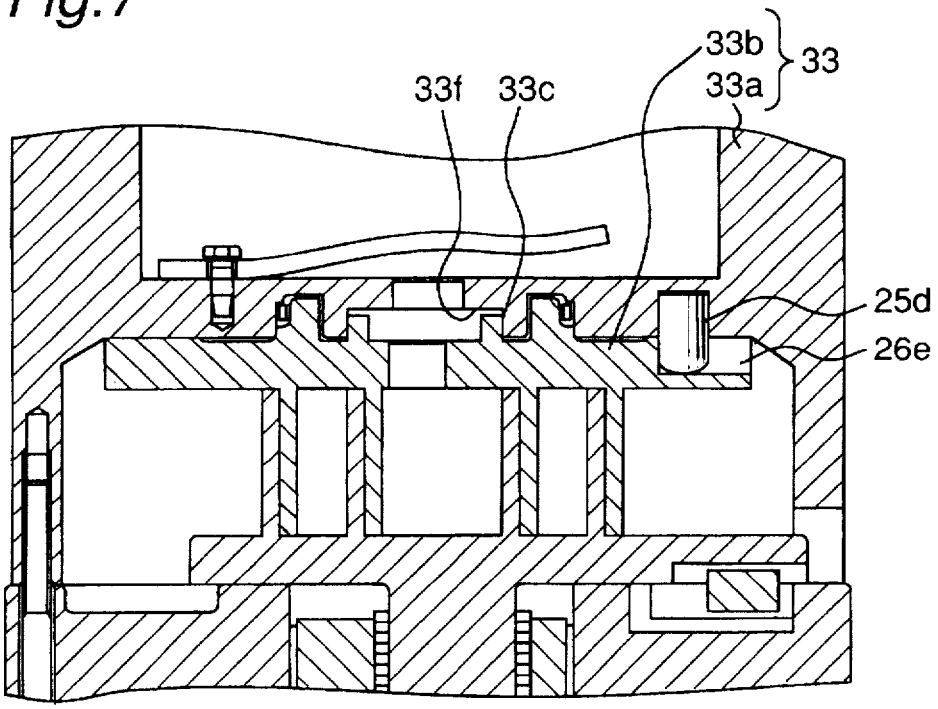
FIG. 7 is a view similar to FIG. 2, but indicating a further modification thereof.

FIG. 7 depicts a further modified form of the non-orbiting scroll. As shown in FIG. 7, a non-orbiting scroll 33 comprises a frame portion 33a having a downwardly open round recess 33f defined therein at the center thereof and a non-orbiting end plate 33b having a cylindrical wall 33c integrally formed therewith so as to extend upwardly therefrom. The cylindrical wall 33c is axially slidably received in the round recess 33f of the frame portion 33a. The center of the cylindrical wall 33c is aligned with that of the non-orbiting end plate 33b, while the center of the round recess 33f is aligned with that of the frame portion 33a.

In the non-orbiting scroll 33 of the above-described construction, the radial positioning of the non-orbiting end plate 33b relative to the frame portion 33a is determined by engagement of the cylindrical wall 33c of the non-orbiting end plate 33b with a side wall of the round recess 33f of the frame portion 33a.

Because the non-orbiting end plate 33b has a radially elongated recess 26e identical in configuration to that shown in FIGS. 2 and 3, description thereof is omitted for brevity's sake.

In the above-described embodiments, because the non-orbiting end plate may excessively tilt to such an extent that the smooth axial movement thereof relative to the frame portion is prevented, the dimensional relationship of the non-orbiting scroll is hereinafter discussed with reference to FIGS. 8 to 10.

Figure 8:
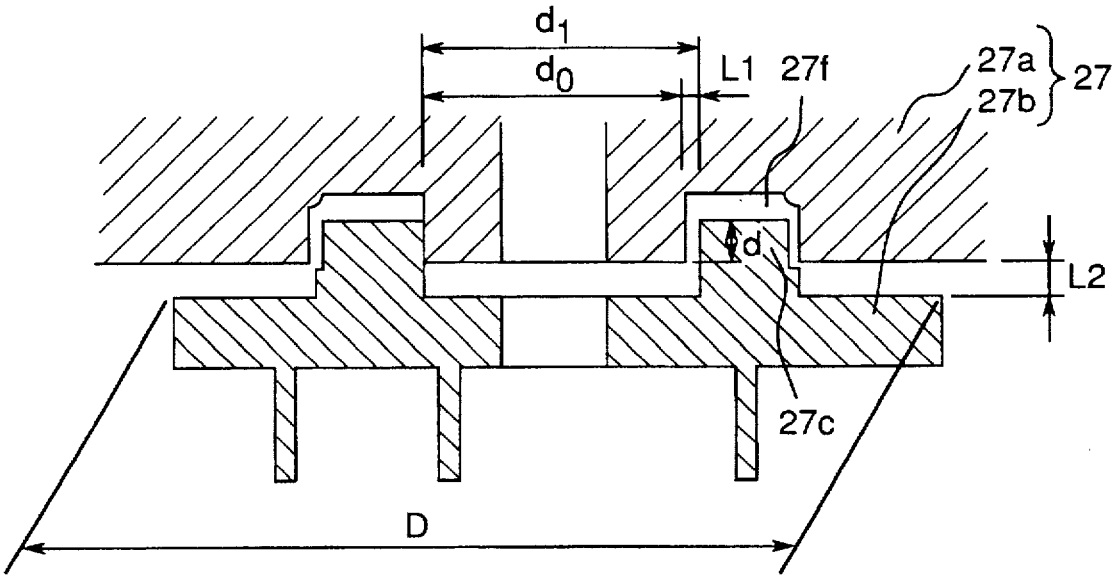
FIG. 8 is a vertical sectional view of a non-orbiting end plate and a frame portion, particularly indicating the dimensional relationship thereof.

As shown in FIG. 8, a non-orbiting scroll 27 includes a frame portion 27a having a cylindrical recess 27f defined therein and a non-orbiting end plate 27b having a cylindrical wall 27c slidably received in the cylindrical recess 27f. In FIG. 8, D indicates the outer diameter of the non-orbiting end plate 27b, $d_0$ the inner diameter of the cylindrical recess 27f, $d_1$ the inner diameter of the cylindrical wall 27c, L1 the maximum clearance between the internal wall surface of the cylindrical recess 27f and the internal surface of the cylindrical wall 27c ($L1=d_1-d_0$), d the axial length of that portion of the cylindrical wall 27c which is inserted into the cylindrical recess 27f, and L2 the maximum movable length of the non-orbiting end plate 27b when the compression mechanism has been assembled.

Figure 9:
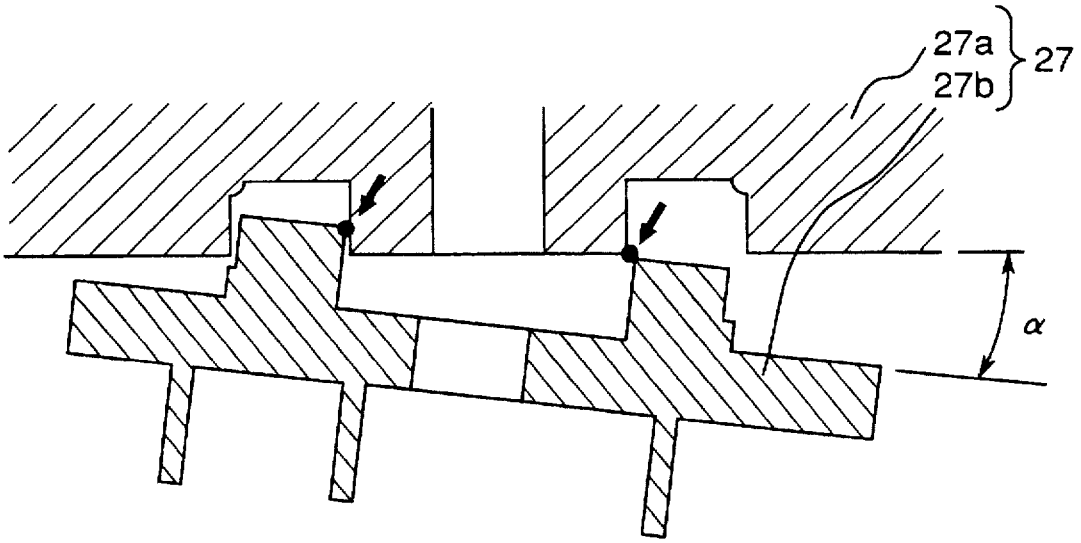
FIG. 9 is a vertical sectional view of the non-orbiting end plate and the frame portion when a cylindrical wall formed on the non-orbiting end plate is brought into contact with the internal wall surface of a cylindrical recess defined in the frame portion at two diametrically opposite locations.

As shown in FIG. 9, if the cylindrical wall 27c is brought into contact with the internal wall surface of the cylindrical recess 27f at two diametrically opposite locations, the smooth axial movement of the non-orbiting end plate 27b relative to the frame portion 27a is prevented. Under the condition shown in FIG. 9, the angle α of tilt of the non-orbiting end plate 27b is given by:

$$\alpha = \tan^{-1}\frac{d_1 - d_0}{d} = \tan^{-1}\frac{L1}{d}$$

Figure 10:
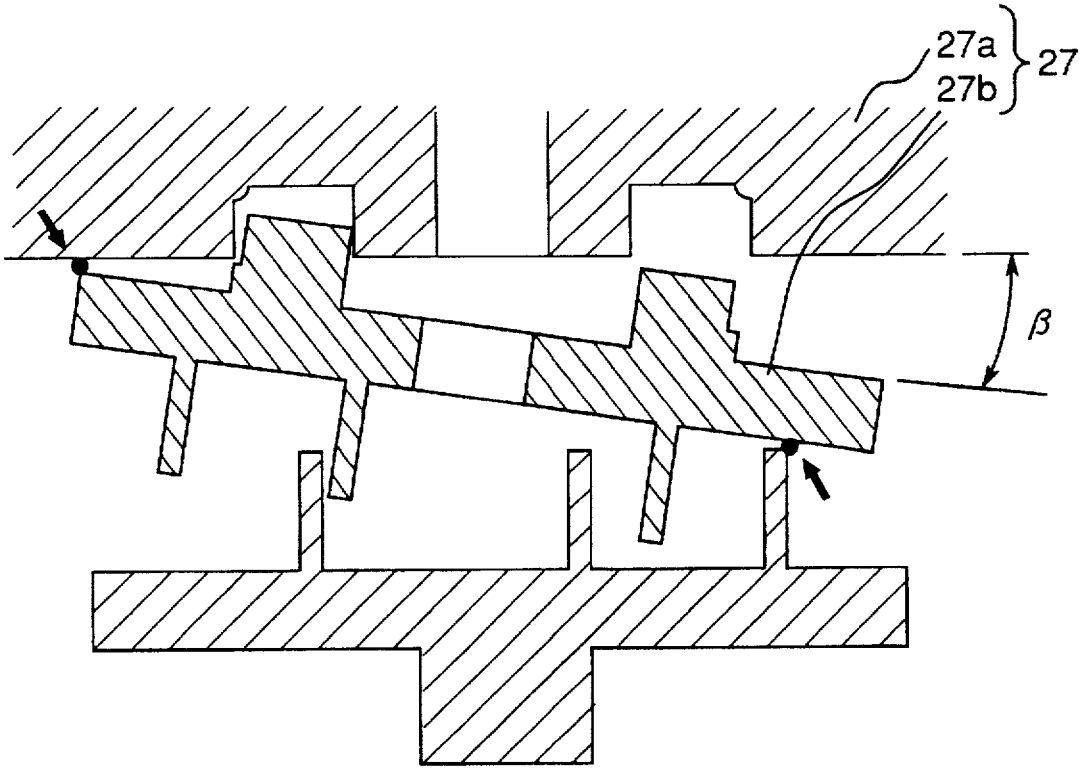
FIG. 10 is a vertical sectional view of the non-orbiting end plate and the frame portion when an outer edge of the non-orbiting end plate is brought into contact with the lower surface of the frame portion, while the lower surface of the non-orbiting end plate is brought into contact with an upper end of an orbiting scroll wrap.
Figure 11:
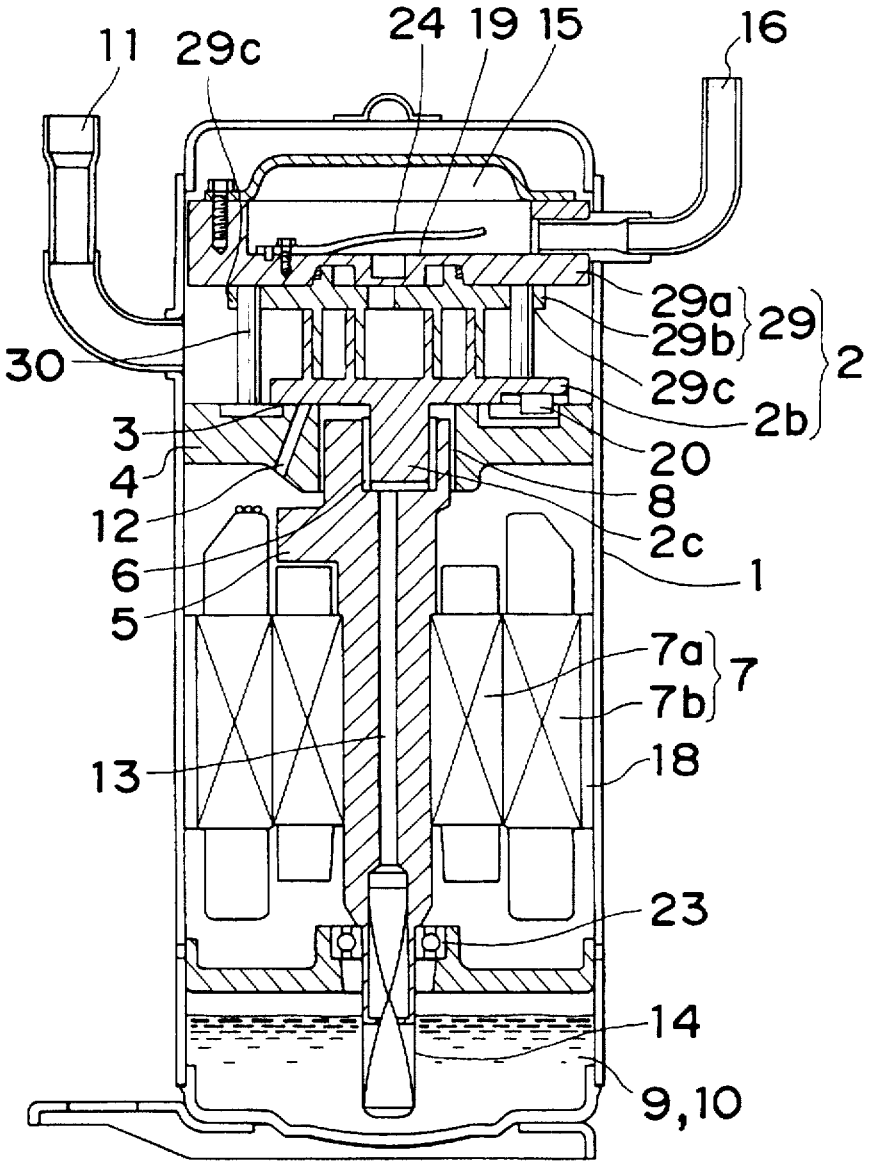
Fig.11 PRIOR ART
FIG. 11 is a vertical sectional view of a conventional scroll compressor.

On the other hand, as shown in FIG. 10, if the non-orbiting end plate 27b is allowed to tilt to such an extent that an upper edge thereof is brought into contact with the lower surface of the frame portion 27a, while the lower surface of the non-orbiting end plate 27b is brought into contact with an upper end of the orbiting scroll wrap, the angle β of tilt of the non-orbiting end plate 27b is given by:

$$\beta = \tan^{-1}\frac{L2}{D}$$

Accordingly, if α is greater than β ($\tan^{-1}L1/d > \tan^{-1}L2/D$), the phenomenon as shown in FIG. 9 does not occur, enabling the smooth axial movement of the non-orbiting end plate 27b relative to the frame portion 27a and preventing gas leakage at the free ends of the non-orbiting and orbiting scroll wraps.

As described above, according to the present invention, because the radial and circumferential positioning of the non-orbiting end plate relative to the frame portion is achieved by engagement of the cylindrical wall with its associated recess and by engagement of the pin with the round or elongated recess, the discrete non-orbiting end plate and the frame portion constituting the non-orbiting scroll can be readily accurately assembled together as if they are of one-piece construction. Accordingly, the positional relationship between the non-orbiting and orbiting scroll wraps during compression is maintained as designed, resulting in a highly efficient and inexpensive scroll compressor. Furthermore, a combination of the cylindrical wall and its associated recess makes it possible to axially smoothly move the non-orbiting end plate relative to the frame portion, thereby preventing gas leakage at the free ends of the non-orbiting and orbiting scroll wraps.

In addition, appropriate selection of the clearance between the cylindrical wall and the corresponding recess, the clearance between the non-orbiting end plate and the frame portion, and the outer diameter of the non-orbiting end plate enables the non-orbiting end plate to axially smoothly move relative to the frame portion under any circumstances.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A scroll compressor having a closed vessel, a compression mechanism accommodated in the closed vessel and including a non-orbiting scroll and an orbiting scroll in engagement with each other, and a drive mechanism for driving the compression mechanism, wherein:

said non-orbiting scroll comprises a frame portion and a non-orbiting end plate axially movable relative to said frame portion;

said frame portion has a recess defined therein, and said frame portion has a pin secured thereto; and said non-orbiting end plate has a cylindrical wall integrally formed therewith and loosely received in said recess, thereby radially positioning said non-orbiting end plate relative to said frame portion, said non-orbiting end plate also having a recess defined therein in which said pin is loosely received, thereby circumferentially positioning said non-orbiting end plate relative to said frame portion, said recess of said non-orbiting end plate being elongated and having opposing straight side walls extending parallel to each other, said recess of said non-orbiting end plate being open at one end thereof.

2. The scroll compressor according to claim 1, wherein said cylindrical wall is positioned radially inwardly of said pin.

3. The scroll compressor according to claim 1, wherein said non-orbiting end plate is radially positioned relative to said frame portion by engagement of an internal surface of said cylindrical wall with an internal wall surface of said recess of said frame portion.

4. The scroll compressor according to claim 1, wherein said non-orbiting end plate is radially positioned relative to said frame portion by engagement of an external surface of said cylindrical wall with an external wall surface of said recess of said frame portion.

5. The scroll compressor according to claim 1, wherein said recess of said non-orbiting end plate opens through an outer peripheral surface of said non-orbiting end plate.

6. The scroll compressor according to claim 1, wherein said cylindrical wall is positioned radially outwardly of said pin.

7. The scroll compressor according to claim 6, wherein said cylindrical wall extends from an outer edge of said non-orbiting end plate.

8. The scroll compressor according to claim 1, wherein a maximum movable length of said non-orbiting end plate is determined by a formula of $\tan^{-1}L1/d>\tan^{-1}L2/D$, wherein L1: a maximum clearance between an internal wall surface of said recess and an internal surface of said cylindrical wall, d: an axial length of that portion of said cylindrical wall which is inserted into said recess, L2: a maximum movable length of said non-orbiting end plate in an axial direction when said compression mechanism has been assembled, and D: an outer diameter of said non-orbiting end plate.

9. The scroll compressor according to claim 8, wherein said non-orbiting scroll includes a non-orbiting scroll wrap secured to said non-orbiting end plate, and said orbiting scroll includes an orbiting end plate and an orbiting scroll wrap secured to said orbiting end plate and being in engagement with said non-orbiting scroll wrap; and said frame portion, said non-orbiting end plate and said orbiting scroll are arranged such that said cylindrical wall of said non-orbiting end plate is prevented from simultaneously contacting diametrically opposite portions of an internal wall surface of said recess of said frame portion.

10. The scroll compressor according to claim 8, wherein said non-orbiting scroll includes a non-orbiting scroll wrap secured to said non-orbiting end plate, and said orbiting scroll includes an orbiting end plate and an orbiting scroll wrap secured to said orbiting end plate and being in engagement with said non-orbiting scroll wrap; and said frame portion, said non-orbiting end plate and said orbiting scroll are arranged such that said cylindrical wall of said non-orbiting end plate is prevented, by contact between an outer peripheral edge portion of said non-orbiting end plate and by contact between said orbiting scroll wrap and a surface of said non-orbiting end plate facing said orbiting scroll wrap, from simultaneously contacting diametrically opposite portions of an internal wall surface of said recess of said frame portion.

11. The scroll compressor according to claim 1, wherein said recess of said non-orbiting end plate is elongated in a radial direction.

12. The scroll compressor according to claim 11, wherein said one end at which said recess of said non-orbiting end plate is open comprises a radially outermost end of said recess of said non-orbiting end plate.

* * * * *